US008622505B2

(12) United States Patent
Fujikura

(10) Patent No.: US 8,622,505 B2
(45) Date of Patent: Jan. 7, 2014

(54) IMAGE FORMING APPARATUS INCLUDING COOLING DEVICE THAT COOLS A RECORDING MEDIUM AND IMAGE FORMING METHOD INCLUDING COOLING A RECORDING MEDIUM

(75) Inventor: Tatsuo Fujikura, Kanagawa (JP)

(73) Assignee: FUJIFILM Corporation, Tokyo (JP)

( * ) Notice: Subject to any disclaimer, the term of this patent is extended or adjusted under 35 U.S.C. 154(b) by 87 days.

(21) Appl. No.: 13/305,745

(22) Filed: Nov. 29, 2011

(65) Prior Publication Data

US 2012/0162304 A1 Jun. 28, 2012

(30) Foreign Application Priority Data

Dec. 27, 2010 (JP) ..... 2010-290835

(51) Int. Cl.
*B41J 29/377* (2006.01)

(52) U.S. Cl.
USPC ..... 347/18; 347/17; 347/102

(58) Field of Classification Search
USPC ..... 347/14, 16–19, 101, 102, 104
See application file for complete search history.

(56) References Cited

U.S. PATENT DOCUMENTS 5,644,350 A * 7/1997 Ando et al. ..... 347/101
6,059,406 A * 5/2000 Richtsmeier et al. ..... 347/102

FOREIGN PATENT DOCUMENTS

JP 10-016418 A 1/1998
JP 2002-62702 2/2002
JP 2005-7760 1/2005
JP 2006-259223 9/2006

OTHER PUBLICATIONS

Partial English language translation of the following: Office action dated Feb. 5, 2013 from the Japanese Patent Office in a Japanese patent application corresponding to the instant patent application. This office action translation is submitted now in order to supplement the understanding of patent document JP 2005-7760 and JP2002-62702 which are cited in the office action and are being disclosed in the instant Information Disclosure Statement.

Partial English language translation of the following: Office action dated May 7, 2013 from the Japanese Patent Office in a Japanese patent application corresponding to the instant patent application. This office action translation is submitted now in order to supplement the understanding of patent document JP2006-259223 which is cited in the office action and is being disclosed in the instant Information Disclosure Statement.

* cited by examiner

*Primary Examiner* — Juanita D Jackson
(74) *Attorney, Agent, or Firm* — SOLARIS Intellectual Property Group, PLLC

(57) ABSTRACT

An apparatus and method which can suppress the occurrence of set off when recording media are stacked on a discharge unit. Ink droplets are ejected to a sheet by inkjet heads in a drawing section, and an image is fixed to the sheet by heating in a fixing section. After that, during the sheet is conveyed by a conveying belt, cooling air is sent to plural fans by a cooler such that the cooling air is blown against the fans, and air is blown to the sheet by the plural fans. Accordingly, the sheet which is after fixing is cooled. The sheet, which has been cooled during being conveyed by the conveying belt, is stacked on a discharge tray.

8 Claims, 4 Drawing Sheets

IMAGE FORMING APPARATUS INCLUDING COOLING DEVICE THAT COOLS A RECORDING MEDIUM AND IMAGE FORMING METHOD INCLUDING COOLING A RECORDING MEDIUM

CROSS-REFERENCE TO RELATED APPLICATION

This application claims priority under 35 USC 119 from Japanese Patent Application No. 2010-290835 filed Dec. 27, 2010, the disclosure of which is incorporated by reference herein.

BACKGROUND OF THE INVENTION

1. Field of the Invention

The present invention relates to an image forming apparatus and an image forming method.

2. Related Art

Conventionally, there has been known an image forming apparatus that ejects ink droplets to a recording medium such as a sheet by inkjet recording heads.

In this image forming apparatus, ink droplets are ejected to recording medium, the ink droplets ejected to the recording medium are dried and fixed by heating, the recording media are sequentially discharged and stacked on a sheet discharge section. In this image forming apparatus, ink transferring (set off, blocking) are generated between the recording media that overlap each other in the vertical direction when recording media are stacked on the sheet discharge section.

Since the same phenomenon as described above occurs even in offset printing machines in the market, powder containing such as starch is generally sprayed between recording media to avoid set off.

Since there is a lot of moisture contained in ink in a case of an image forming apparatus using inkjet recording heads, as compared to an offset printing machine, set off is apt to occur. For this reason, a powder device, which sprays powder, is used in the image forming apparatus in the similar way as an offset printing machine. However, since much more powder needs to be sprayed than powder used in an offset printing machine, accordingly it is required that the amount of powder be reduced or that powder be made unnecessary.

Further, Japanese Patent Application Laid-Open (JP-A) No. 10-16418 (Patent Document 1) discloses an apparatus that, after printing, cools ink transferred to a recording medium or the vicinity of a portion where ink and ink-curing (hardening) liquid comes into contact with each other by a cooling device and fixes the ink, before, while, or after ink-curing liquid comes into contact with or is applied to an ink-transfer surface of the recording medium.

However, a process for cooling a recording medium by a cooling device is not disclosed in Patent Document 1. For this reason, it is not possible to effectively suppress set off when recording media are stacked on a sheet discharge section. Accordingly, improvement is needed.

SUMMARY OF THE INVENTION

The invention has been made in consideration of the above-mentioned circumstances, and an object of the invention is to provide an image forming apparatus that can suppress the occurrence of set off when recording media are stacked on a discharge unit.

According to a first aspect of the present invention, there is provided an image forming apparatus including a liquid droplet ejection device that ejects liquid droplets onto a recording medium; a fixing device that fixes the ejected liquid droplets to the recording medium by heating; a discharge unit on which the recording medium is sequentially discharged and stacked; and a cooling device that cools the recording medium before the recording medium is stacked on the discharge unit after the recording medium is heated by the fixing device.

According to the first aspect of the present invention, after liquid droplets are ejected to the recording medium by the liquid droplet ejection device, the liquid droplets ejected to the recording medium are heated by the fixing device and fixed to the recording medium. Further, before the recording medium is stacked on the discharge unit after the recording medium is heated by the fixing device, the recording medium is cooled by the cooling device. The recording medium cooled by the cooling device is stacked on the discharge unit. That is, due to that the recording medium having been heated by the fixing device is cooled by the cooling device before the recording medium is stacked on the discharge unit, the temperature of the image fixed to the recording medium is lowered. Accordingly, the generation of ink transferring (set off, blocking) between the recording media stacked on the discharge unit is suppressed.

According to a second aspect, in the image forming apparatus according to the first aspect of the present invention, the cooling device includes a fan that blows air to the recording medium.

According to the second aspect, air (wind) is blown to the recording medium by the fan. Accordingly, the recording medium is cooled in a non-contact state, so that the generation of ink transferring (set off) between the recording media stacked on the discharge unit is suppressed.

According to a third aspect, in the image forming apparatus according to the second aspect of the present invention, the fan blows the air toward an upstream side in a conveying direction of the recording medium.

According to the third aspect, the fan blows air toward the upstream side in the conveying direction of the recording medium, so that the transfer of heat from the fixing device to a cooling position of the recording medium is suppressed. Further, as compared to a case where air is blown toward the downstream side in the conveying direction of the recording medium, the period of time of air being blown against the recording medium is increased due to a relationship between the speed of air and the conveying speed of the recording medium. Accordingly, cooling efficiency is high.

According to a fourth aspect, in the image forming apparatus according to any one of the first to third aspects of the present invention, the cooling device includes a cooler, which lowers a temperature around the recording medium, or the cooling device includes a cooler provided together with the fan, the cooler lowering a temperature around the recording medium.

According to the fourth aspect, the cooling device includes a cooler, which lowers the temperature around the recording medium, instead of the fan or provided together with the fan. Accordingly, the recording medium is effectively cooled in a non-contact state, so that the generation of ink transferring (set off) between the recording media stacked on the discharge unit is suppressed.

According to a fifth aspect, in the image forming apparatus according to any one of the first to third aspects of the present invention, the cooler is disposed above the recording medium which is conveyed in the cooling device.

According to the fifth aspect, since the cooler is disposed above the recording medium, cold air goes down. Accordingly, the heated image, which is fixed to the recording medium, is more effectively cooled in a non-contact state.

According to a sixth aspect, in the image forming apparatus according to the first aspect of the present invention, the cooling device is a cooling roller that is rotated while contacting the recording medium.

According to the sixth aspect, the cooling device is the cooling roller that is rotated with coming into contact with the recording medium. Accordingly, the recording medium is cooled by the cooling roller, so that the generation of ink transferring (set off) between the recording media stacked on the discharge unit is suppressed. Further, cooling efficiency is improved as compared to a non-contact type cooling method.

In the above mentioned aspects, it is possible that an air blowing direction of the fan is substantially opposite to a conveying direction of the recording medium.

In the above mentioned aspects, it is possible that the fan is disposed at a position against which cool air blown out from a blow-out portion of the cooler is blown.

According to a seventh aspect of the present invention, there is provided an image forming method including: ejecting liquid droplets onto a recording medium; fixing the ejected liquid droplets to the recording medium by heating; cooling the recording medium that has been heated by the fixing; and discharging the recording medium that has been cooled by the cooling, and stacking the recording medium on a discharge unit.

According to the seventh aspect, liquid droplets are ejected to a recording medium by ejecting process, and the liquid droplets, which have been ejected to the recording medium, are fixed by heating by fixing process. Further, in cooling process, the recording medium heated by the fixing process is cooled in a non-contact state. After that, in discharging process, the recording medium cooled by the cooling process is discharged and the recording medium is stacked on the discharge unit. That is, before the recording medium is stacked on the discharge unit after fixing, the recording medium is cooled by the cooling process. Accordingly, the temperature of the image fixed to the recording medium is lowered, so that the generation of ink transferring (set off) between the recording media stacked on the discharge unit is suppressed.

Since the invention has the above-mentioned configuration, it is possible to suppress the occurrence of set off when recording media are stacked on a discharge unit.

BRIEF DESCRIPTION OF THE DRAWINGS

Embodiments of the invention will be described in detail with reference to the following figures, wherein.

DETAILED DESCRIPTION OF THE INVENTION

An example of an embodiment of the invention will be described below with reference to the drawings.

<Entire Configuration>

Figure 1:
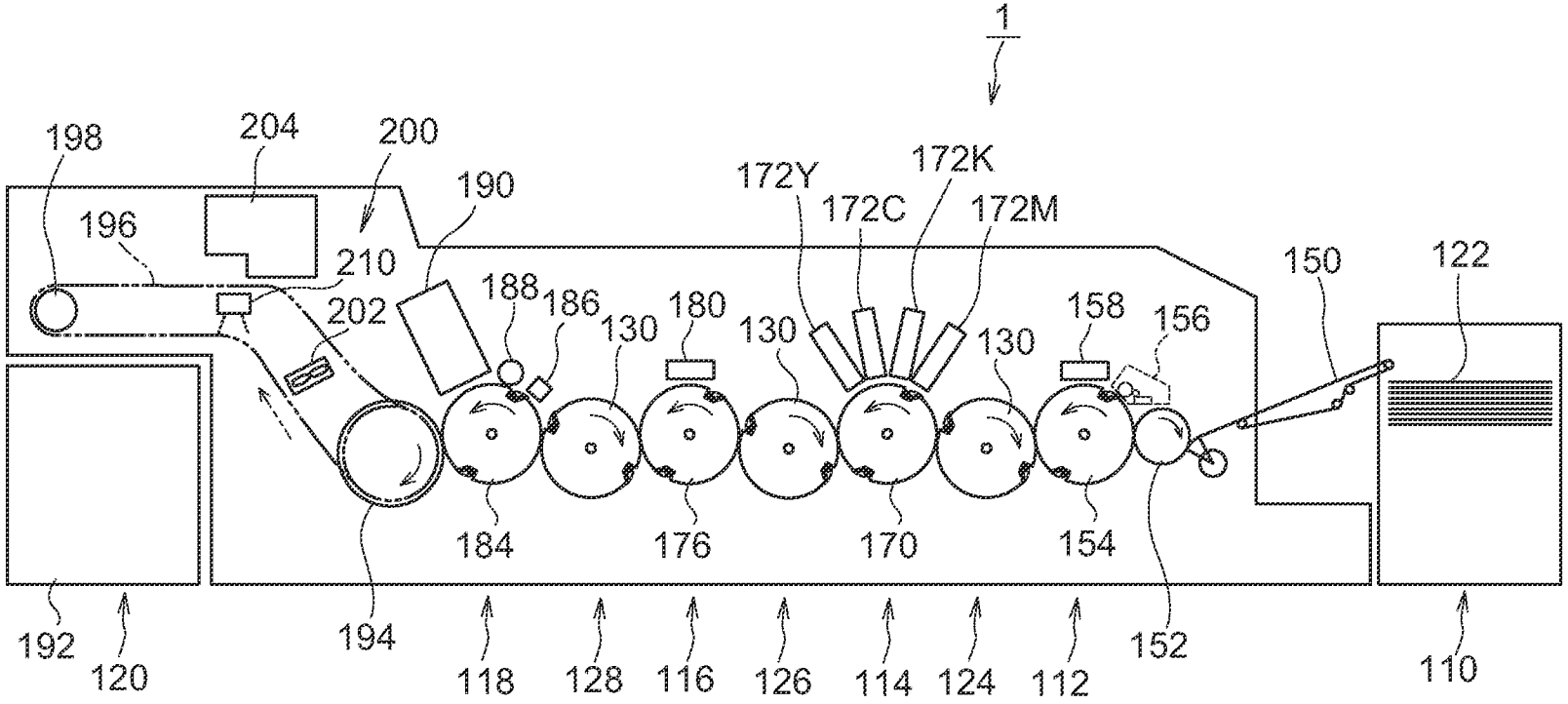
FIG. 1 is a conceptual diagram showing the entire configuration of an image recording apparatus according to an embodiment of the invention.
Figure 2:
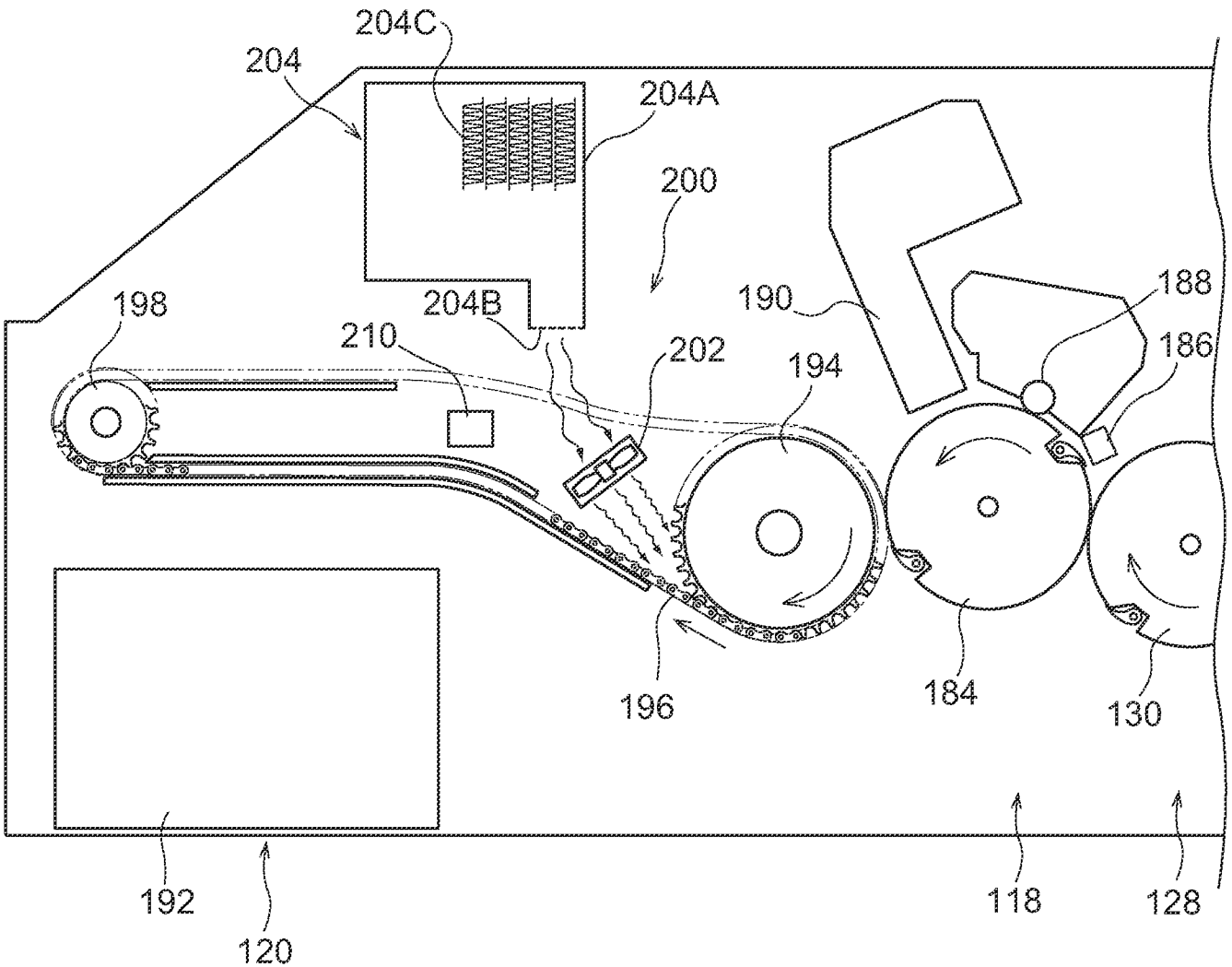
FIG. 2 is a view showing the configuration of a cooling device that is used in the image recording apparatus according to the embodiment of the invention.

An example of an inkjet image forming apparatus, which is to apply an image forming method according to the invention, will be described below with reference to FIGS. 1 and 2. FIG. 1 is a conceptual diagram (side surface) showing the entire apparatus, and FIG. 2 is a conceptual diagram (side surface) focusing on a cooler and fans as an example of a cooling device.

An inkjet recording apparatus 1 is an impression cylinder direct-drawing type inkjet recording apparatus that forms a desired color image by ejecting plural color inks (liquid droplets) to a sheet 122 as an example of a recording medium, which is held on an impression cylinder (a drawing drum 170) of a drawing section 114, from inkjet heads 172M, 172K, 172C, and 172Y as an example of a liquid droplet ejection device; and is an on-demand type image forming apparatus to which a two-liquid reaction (aggregating) method is applied. The two-solution (liquid) reaction (aggregating) method forms an image on a sheet 122 by applying process solution (ink aggregate process solution) to the sheet 122 as a recording medium before the ink ejection and making the process solution and an ink react with each other.

The inkjet recording apparatus 1 mainly includes a sheet feed (supply) section 110, a process solution applying section 112, a drawing section 114, a drying section 116, a fixing section 118, and a sheet discharge section 120.

The sheet feed section 110 is a mechanism that feeds sheets 122 to the process solution applying section 112. Sheets 122, which are paper sheets, are stacked in the sheet feed section 110. The sheet feed section 110 is provided with a sheet feed (supply) tray 150, so that the sheets 122 are fed one by one to the process solution applying section 112 from the sheet feed tray 150. In the inkjet recording apparatus 1, plural kinds of sheets 122 having different types or sizes (medium sizes) may be used as the sheets 122. Meanwhile, a case where paper sheets (cut sheets) are used as the sheets 122 will be described in this embodiment.

The process solution applying section 112 is a mechanism that applies process solution to the recording surface of a sheet 122. Since the process solution contains a color material aggregate-agent that aggregates a color material of the ink applied in the drawing section 114, the separation of the ink to a color material and a solvent is facilitated by the contact between the process solution and an ink.

As shown in FIG. 1, the process solution applying section 112 includes a sheet feed (supply) cylinder 152, a process solution drum 154, and a process solution applying device 156. The process solution drum 154 is a drum that holds a sheet 122 and conveys the sheet 122 by being rotated. The process solution drum 154 includes claw-shaped holders (grippers) on the outer peripheral surface thereof, and is adapted to be capable of holding the (leading) end of the sheet 122 by making the sheet 122 be interposed between claw of the holder and the peripheral surface of the process solution drum 154.

Suction holes may be formed at the outer peripheral surface of the process solution drum 154 and a suction section, which performs section from the suction holes, may be connected. Accordingly, it is possible to closely hold a sheet 122 on the peripheral surface of the process solution drum 154.

The process solution applying device 156 is provided outside the process solution drum 154 so as to face the peripheral surface of the process solution drum 154. The process solution applying device 156 includes a process solution container in which process solution is stored, an anilox roller of which a part is immersed in the process solution of the process solution container, and a rubber roller that comes into press contact with the anilox roller and the sheet 122 held on the process solution drum 154 and transfers measured process solution to the sheet 122. According to the process solution applying device 156, it is possible to apply process solution to the sheet 122 while measuring (metering) the process solution. A drying device 158, which dries (removes) the process solution applied to the sheet 122, is provided on the downstream side of the process solution applying device 156 in the conveying direction of the sheet 122. Although not shown in the drawings, for example, hot air heaters and IR (infrared) heaters are provided in the drying device 158.

The sheet 122, to which the process solution has been applied by the process solution applying section 112, is delivered to the drawing drum 170 of the drawing section 114 from the process solution drum 154 through an intermediate conveying portion 124 (a transfer cylinder 130). The drawing section 114 includes the drawing drum 170 and inkjet heads 172M, 172K, 172C, and 172Y. The drawing drum 170 includes claw-shaped holders (grippers) on the outer peripheral surface thereof, like the process solution drum 154. The sheet 122 fixed to the drawing drum 170 is conveyed while the recording surface of the sheet facing the outside, and inks are applied to the recording surface from the inkjet heads 172M, 172K, 172C, and 172Y.

Each of the inkjet heads 172M, 172K, 172C, and 172Y is a full-line type inkjet recording head (an inkjet head) that has the length corresponding to the maximum width of an image forming area of the sheet 122. A nozzle array, which is formed of plural ink ejection nozzle arranged over the entire width of the image forming area, is formed on the ink ejection surface of each of the inkjet heads. Each of the inkjet heads 172M, 172K, 172C, and 172Y is installed so as to extend in a direction orthogonal to the conveying direction of the sheet 122 (the rotating direction of the drawing drum 170).

When liquid droplets of corresponding color inks are ejected toward the recording surface of the sheet 122, which is closely held on the drawing drum 170, from the respective inkjet heads 172M, 172K, 172C, and 172Y, the inks come into contact with the process solution previously applied to the recording surface by the process solution applying section 112 and resin particles and pigments dispersed in the inks are aggregated. As a result, aggregate-parts are formed. Accordingly, the flows of the pigments or the like on the sheet 122 are prevented, so that an image is formed on the recording surface of the sheet 122.

The sheet 122 on which an image has been formed by the drawing section 114 is delivered to a drying drum 176 of the drying section 116 from the drawing drum 170 through an intermediate conveying portion 126. The drying section 116 is a mechanism that dries (removes) moisture contained in a solvent separated due to aggregate action. The drying section 116 includes the drying drum 176 and a drying device 180. Although not shown in the drawings, for example, plural IR (infrared) heaters and hot air heaters disposed between the respective IR heaters are provided in the drying device 180.

The drying drum 176 includes claw-shaped holders (grippers) on the outer peripheral surface thereof, like the process solution drum 154. The drying drum 176 is adapted so as to be capable of holding the end of the sheet 122 by the holder. The temperature of hot air, which is blown toward the sheet 122 from hot air heater (not shown in the drawings), and the temperature of each of the IR heaters (not shown in the drawings) are detected by temperature sensor and sent to a controller (not shown in the drawings) as temperature information. The temperature and volume of hot air and the temperature of each of the IR heaters are appropriately adjusted on the basis of the temperature information, so that various drying conditions are achieved.

Meanwhile, the surface temperature of the drying drum 176 may be set to 50° C. or more. Heating is performed from the back of the sheet 122, so that drying is facilitated. Accordingly, it is possible to prevent the destruction of an image at the time of the fixing of the image. Meanwhile, the upper limit of the surface temperature of the drying drum 176 is not particularly limited, but is preferably set to 75° C. or less (more preferably set to 60° C. or less) in terms of the safety (the prevention of burns caused by high temperature) of maintenance such as the cleansing of the ink adhering to the surface of the drying drum 176.

Further, since it is found that the expansion and contraction of a sheet 122 are less when drying cylinder temperature (the surface temperature of the drying drum 176) is high (a sheet is strongly dried), it is possible to reduce the influence of cockles when the surface temperature of the drying drum 176 is high without loss of the above-mentioned safety.

The sheet 122 is held on the outer peripheral surface of the drying drum 176 so as to allow the recording surface of the sheet 122 to face the outside (that is, in a state in which the sheet 122 is curved so that the recording surface of the sheet 122 becomes a convex side) and is dried while the drying drum conveys the sheet 122 by being rotated. Accordingly, it is possible to prevent the sheet 122 from creasing and floating and to prevent the uneven drying of the sheet caused by the creasing and floating of the sheet.

The sheet 122, which has been dried by the drying section 116, is delivered to a fixing drum 184 of the fixing section 118 from the drying drum 176 through an intermediate conveying portion 128. The fixing section 118 includes the fixing drum 184, a drying device 186, a fixing roller 188 as an example of a fixing device, and an in-line sensor 190. Although not shown in the drawings, the drying device 186 is formed of, for example, IR heater. The drying device 186 is disposed on the upstream side in the conveying direction of the sheet 122 by the fixing drum 184, and the fixing roller 188 is disposed on the downstream side of the drying device 186 in the conveying direction of the sheet 122.

The fixing drum 184 includes claw-shaped holders (grippers) on the outer peripheral surface thereof, like the process solution drum 154. The fixing drum 184 is adapted so as to be capable of holding the end of the sheet 122 by the holder. The sheet 122 is conveyed by the rotation of the fixing drum 184 while the recording surface of the sheet faces the outside. Drying performed by the drying device 186, fixing performed by the fixing roller 188, and inspection performed by the in-line sensor 190 are performed on the recording surface.

The fixing roller 188 is a roller member that melts and attaches resin particles contained in the inks (particularly, self-dispersible polymer particles) to the sheet by heating and pressing the inks and forms a film with the inks. The fixing roller 188 is adapted to heat and press the sheet 122.

Specifically, the fixing roller 188 is disposed so as to come into press contact with the fixing drum 184, and the fixing roller 188 and the fixing drum 184 form nip rollers. Accordingly, the sheet 122 is interposed between the fixing roller 188 and the fixing drum 184, is nipped at a predetermined nip pressure (for example, 0.15 MPa), and is subjected to the fixing of an image.

Further, the fixing roller 188 is formed of a heating roller where a halogen lamp is assembled inside a metal pipe made of aluminum or the like having high thermal conductivity, and the temperature thereof is controlled to a predetermined temperature (for example, 60 to 80° C.).

The sheet 122 is heated by the heating roller, so that thermal energy corresponding to a temperature equal to or higher than Tg (glass-transition temperature) of the resin particles contained in the inks is applied to the sheet, so that the resin particles are melted. Accordingly, pressure fixing is performed on the concaves and convexs of the sheet 122 and the concaves and convexs of the surface of an image is leveled, so that it is possible to obtain gloss.

The in-line sensor 190 is a measurement unit that is used to measure check patterns, the amount of moisture, the surface temperature, the gloss level, and the like of the image fixed to the sheet 122. A CCD line sensor or the like is used as the in-line sensor 190.

According to the fixing section 118, the resin particles in a thin image layer formed by the drying section 116 are heated and pressed by the fixing roller 188, so that the resin particles are melted. Accordingly, it is possible to fix an image to the sheet 122. Further, the surface temperature of the fixing drum 184 is set to 50° C. or more and the sheet 122 held on the outer peripheral surface of the fixing drum 184 is heated from the back thereof, so that drying is facilitated. Accordingly, it is possible to prevent the destruction of an image at the time of the fixing of the image and to increase the strength of an image by an effect of raising the temperature of the image.

As shown in FIGS. 1 and 2, the sheet discharge section 120 is provided on the downstream side of the fixing section 118 in the conveying direction of the sheet 122. The sheet discharge section 120 includes a discharge tray 192 as an example of a discharge unit. A transfer cylinder 194, a conveying belt 196, and a stretching roller 198 are provided between the discharge tray 192 and the fixing drum 184 of the fixing section 118 so as to face in contact manner to the discharge tray 192 and the fixing drum 184. In this embodiment, the conveying belt 196 is formed of an endless chain member. The conveying belt 196 revolves in the direction of an arrow in a state in which the conveying belt 196 is stretched by the transfer cylinder 194 and the stretching roller 198. Further, the conveying belt 196 includes claw-shaped holders (grippers) on the outer peripheral surface thereof, and is adapted to hold the end of the sheet 122 by making the sheet 122 be interposed between the claw of the holder and the surface of the conveying belt 196. The sheet 122 is delivered to the conveying belt 196 through the transfer cylinder 194. Furthermore, the sheet 122 is conveyed while being held on the conveying belt 196, and is discharged to the discharge tray 192. Sheets 122 on which images have been formed are sequentially discharged and stacked on the discharge tray 192.

Moreover, a cooling section 200, which cools the sheet 122 conveyed by the conveying belt 196, is provided between the fixing section 118 and the discharge tray 192. The cooling section 200 will be described below. In addition, a powder spray device 210, which sprays powder on the sheet 122, is provided above the sheet 122, which is conveyed by the conveying belt 196, on the downstream side of the cooling section 200 in the conveying direction of the sheet 122.

Further, although not shown in FIG. 1, the inkjet recording apparatus 1 includes ink storage tanks that supply inks to the respective inkjet heads 172M, 172K, 172C, and 172Y; a unit that supplies process solution to the process solution applying section 112; a head maintenance unit that performs the cleaning (wiping of nozzle surfaces, purging, suction of nozzles, or the like) of the respective inkjet heads 172M, 172K, 172C, and 172Y; a position detecting sensor that detects the position of the sheet 122 on a medium conveying path; and a temperature sensor that detects the temperature of each part of the apparatus; and the like, other than the above-mentioned structures.

In the inkjet recording apparatus 1 shown in FIG. 1, plural seasoning devices used in the discharge tray 192 may be provided and each of the seasoning devices may be adapted to be capable of moving between the sheet discharge section 120 and the sheet feed section 110.

<Details of Cooling Section>

Figure 3:
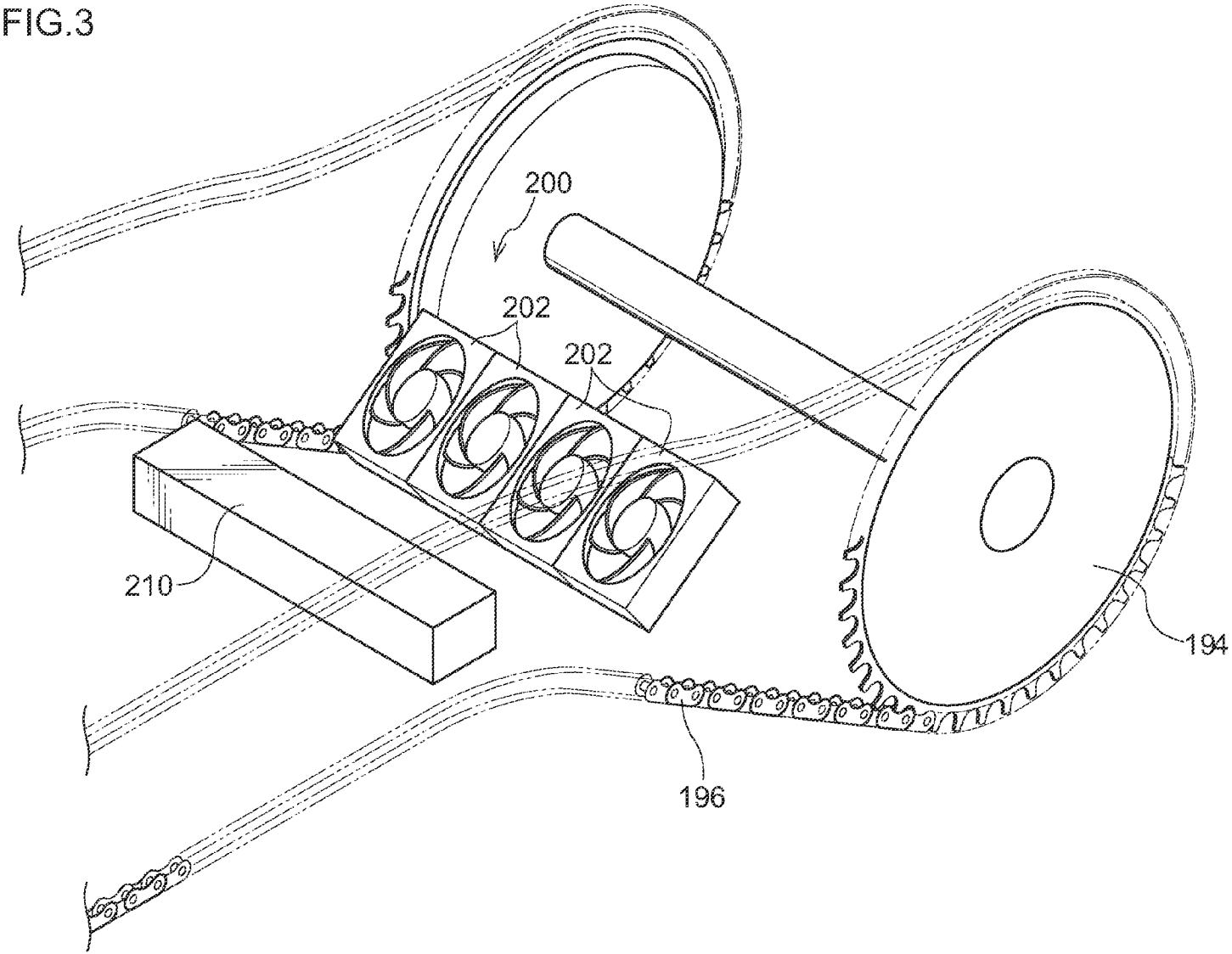
FIG. 3 is a perspective view showing fans as an example of the cooling device.

The details of the cooling section 200 are shown in FIGS. 2 and 3. As shown in FIG. 2, the cooling section 200 includes plural fans 202 as an example of a cooling device that is positioned above the sheet 122 conveyed by the conveying belt 196 (the lower portion of the conveying belt 196 in FIG. 2) so as to face the sheet 122 and blows wind (air) to the sheet 122, and a cooler 204 as an example of a cooling device that lowers the temperature around the sheet 122.

As shown in FIGS. 2 and 3, the plural fans 202 are arranged in line in a direction orthogonal to the moving direction of the conveying belt 196 (a direction crossing the conveying direction of the sheet 122), and are provided so as to blow air toward the upstream side in the conveying direction of the sheet 122 conveyed by the conveying belt 196. That is, the plural fans 202 are adapted to blow air to the entire recording surface of the sheet 122 to the upstream side in the conveying direction from the downstream side in the conveying direction of the sheet 122 conveyed by the conveying belt 196 (the lower portion of the conveying belt 196 in FIG. 2). In this embodiment, the number of the fans 202 is four but may be appropriately changed.

Since the sheet 122 is conveyed by the conveying belt 196 in a state in which the leading end of the sheet 122 is held by the holder (gripper), the flutter of the sheet 122 is suppressed due to blowing air to the sheet 122 toward the upstream side in the conveying direction from the downstream side in the conveying direction of the sheet 122 by the plural fans 202. Further, the transfer of heat from the fixing section 118 to the sheet 122 conveyed in the cooling section 200 is suppressed by blowing air to the sheet 122 toward the upstream side in the conveying direction from the downstream side in the conveying direction of the sheet 122. Furthermore, since the conveying direction of the sheet 122 is substantially opposite to the direction of the air blown from the fans 202, the period of time of air being blown against the sheet 122 is increased in a relationship between the relative speed of air and the sheet 122.

The cooler 204 is disposed above the revolving conveying belt 196 on the slightly downstream side of the fans 202 in the conveying direction of the sheet 122. The cooler 204 includes a blow-out opening 204B that is formed at the lower portion of a housing 204A and a heat exchanger 204C that is disposed inside the housing 204A. The heat exchanger 204C is to cool gas that is to be introduced into the housing 204A from the outside by a fan (not shown in the drawings). The gap cooled by the heat exchanger 204C is blown out from the blow-out opening 204B by a fan. Cool air blown out from the blow-out opening 204B is sent to the lower portion of the conveying belt 196 (the sheet 122, which is being conveyed) through the gaps of the upper portion of the conveying belt 196 that is formed of a chain member.

In this embodiment, the plural fans 202 are provided at the position at (against) which cooling air blown out from the blow-out opening 204B of the cooler 204 is blown, and the cooling air is blown to the sheet 122 by the plural fans 202. Further, the blowing direction of the cooling air may be set toward the plural fans 202 by the adjustment of the direction of a louver provided at the blow-out opening 204B.

Furthermore, since the cooler 204 is disposed above the sheet 122 conveyed by the conveying belt 196 and cold air from the cooler 204 goes down, the sheet 122 is efficiently cooled.

In this embodiment, the cooler 204 is adapted to lower the temperature around the sheet 122, which is conveyed by the conveying belt 196, to temperature (for example, 15 to 30° C.) which is lower than fixing temperature (for example, 60 to 80° C.).

The heat exchanger 204C circulates a refrigerant and cools gas by condensation and evaporation, but is not limited thereto. Various structures, such as a device for sending cold air using a heat exchanger cooled by water flow and a device using Peltier elements, may be used.

In the cooling section 200, cooling air is sent by the cooler 204 and air is blown to the sheet 122, which is conveyed by the conveying belt 196, by the plural fans 202 that are provided at the position at which cooling air is blown. Accordingly, the sheet 122 having been subjected to the fixing of an image is cooled to about normal temperature.

Meanwhile, in this embodiment, the plural fans 202 do not have a function of cooling of air blown to the sheet 122. However, heat exchangers may be provided inside the plural fans 202 so that cooling air is blown to the sheet 122. Accordingly, for example, the cooler 204 may be omitted.

In the sheet discharge section 120, the powder spray device 210 is provided on the downstream side of a position which is positioned below the blow-out opening 204B of the cooler 204 in the conveying direction of the sheet 122 so as to face the sheet 122 that is conveyed by the conveying belt 196. The powder spray device 210 sprays powder, which contains starch or the like, to the recording surface of the sheet 122. Since powder is sprayed to the recording surface of the sheet 122, the occurrence of set off is suppressed when sheets 122 are stacked on the discharge tray 192.

<Operation and Effect>

As shown in FIG. 1, the sheet 122 fed from the sheet feed section 110 is conveyed along the outer peripheral surfaces of the process solution drum 154 and the sheet feed cylinder 152 that are rotated. In the process solution applying section 112, the process solution applying device 156 applies process solution (ink aggregate process solution) to the recording surface of the sheet 122 that is conveyed along the outer peripheral surface of the process solution drum 154.

Moreover, the sheet 122 to which the process solution has been applied is conveyed along the outer peripheral surface of the drawing drum 170 through the intermediate conveying portion 124. In the drawing section 114, the respective color inkjet heads 172M, 172K, 172C, and 172Y eject liquid droplets (inks) to the recording surface of the sheet 122 conveyed by the drawing drum 170, so that an image is formed on the sheet 122. In this case, the inks come into contact with the process solution previously applied to the recording surface by the process solution applying section 112 and resin particles and pigments dispersed in the inks are aggregated. As a result, aggregate parts are formed. Accordingly, the flows of the pigments or the like on the sheet 122 are prevented, so that an image is formed on the recording surface of the sheet 122.

Further, the sheet 122 where the image has been formed on the recording surface is conveyed along the outer peripheral surface of the drying drum 176 through the intermediate conveying portion 126. In the drying section 116, moisture contained in the sheet 122, which is conveyed by the drying drum 176 after the ejection of the inks, is dried (removed) (moisture contained in a solvent separated by aggregate action is reduced) by the heat of the IR heaters and the hot air blown from the hot air heaters, of the drying device 180.

Furthermore, the sheet 122, which is heated to high temperature by the drying device 180, is conveyed along the outer peripheral surface of the fixing drum 184 through the intermediate conveying portion 128. In the fixing section 118, hot air is blown to the sheet 122 from the hot air heater of the drying device 186 and the sheet 122 comes into press contact with the fixing drum 184 and the fixing roller 188, so that the image formed on the sheet 122 is fixed to the sheet 122. In addition, the sheet 122 passes through an opposite position that faces the in-line sensor 190, and the check patterns or the amount of moisture, the surface temperature, the gloss level, and the like on the sheet 122 passing through the opposite position are measured.

Moreover, the sheet 122, which has been measured by the in-line sensor 190, is delivered to the conveying belt 196 by the transfer cylinder 194 and conveyed to the cooling section 200 by the conveying belt 196. In the cooling section 200, cooling air is sent to the vicinity of the plural fans 202 and the conveying belt 196 from the blow-out opening 204B of the cooler 204, and air is blown to the entire recording surface of the sheet 122 toward the upstream side in the conveying direction from the downstream side in the conveying direction of the sheet 122 by the plural fans 202. For this reason, the cooling air from the blow-out opening 204B of the cooler 204 is efficiently blown to the recording surface of the sheet 122, which is conveyed by the conveying belt 196, by the plural fans 202. Accordingly, the sheet 122 having been subjected to the fixing of an image (fixing temperature is in the range of, for example, 60 to 80° C.) is cooled to about normal temperature.

In addition, powder is sprayed to the recording surface of the sheet 122, which is conveyed by the conveying belt 196, from the powder spray device 210. After that, the sheet 122 is discharged to the discharge tray 192. Sheets 122 on which images have been formed by a series of the above-mentioned processes are sequentially discharged and stacked on the discharge tray 192.

In the inkjet recording apparatus 1, cooling air is sent from the blow-out opening 204B of the cooler 204 provided in the cooling section 200 and air is blown to the sheet 122 by the plural fans 202 that are provided at the position at which cooling air is blown, so that the sheet 122 conveyed by the conveying belt 196 is cooled in a non-contact state. Accordingly, the sheets 122 having been subjected to the fixing of an image are cooled by the cooling section 200, and thereafter are stacked on the discharge tray 192. For this reason, since the temperature of the recording surface of the sheet 122 is low as compared to a case where a sheet 122 is stacked on the discharge tray 192 without passing through the cooling section 200 after the fixing of an image, it is possible to suppress the generation of ink transferring (set off) of sheets 122 on the discharge tray 192.

Further, since the leading end of the sheet 122 is held on the conveying belt 196 by the holder (gripper), it is possible to suppress the flutter of the sheet 122 by blowing air to the sheet 122 toward the upstream side in the conveying direction from the downstream side in the conveying direction of the sheet 122 by the plural fans 202. Furthermore, it is possible to suppress the transfer of heat from the fixing section 118 to the cooling position of the sheet 122 in the cooling section 200 by blowing air to the sheet 122 toward the upstream side in the conveying direction from the downstream side in the conveying direction of the sheet 122. Moreover, since the conveying direction of the sheet 122 is opposite to the direction of the air blown from the plural fans 202, the period of time of air being blown against the sheet 122 is increased in a relationship between the relative speed of air and the sheet 122. Accordingly, cooling efficiency is high.

Further, since the cooler 204 is disposed above the sheet 122 conveyed by the conveying belt 196 and cold air from the cooler 204 goes down, it is possible to more effectively cool the image that is fixed to the sheet 122 and heated.

Meanwhile, the cooling section 200 includes the plural fans 202 and the cooler 204 in this embodiment, but is not limited thereto. As long as the cooling section can cool a sheet 122 that has been subjected to the fixing of an image and is conveyed by the conveying belt 196, the structure of the cooling section may be changed to other structures. For example, a cold air blower, which blows cooling air to a sheet 122, may be provided instead of the plural fans 202.

Figure 4:
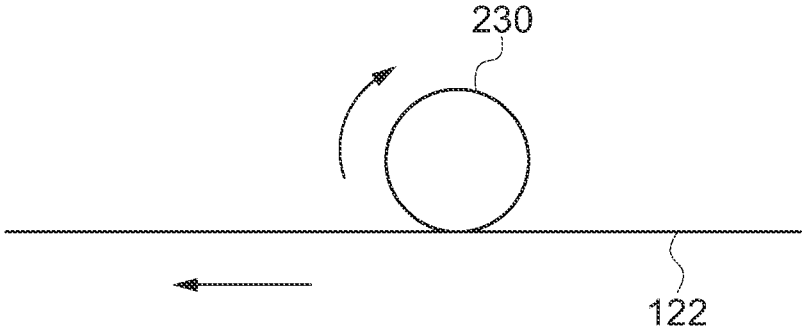
FIG. 4 is a view showing a cooling roller according to the modified embodiment of the invention.

Moreover, in this embodiment, the plural fans 202 and the cooler 204 cool the sheet 122 in a non-contact state. However, a cooling device, which cools the sheet 122 with coming into contact with the sheet 122, may be provided. For example, the sheet 122 may be cooled by a cooling roller 230 (FIG. 4) that is rotated while coming into contact with the sheet 122. For example, a method of circulating a refrigerant in the cooling roller 230, and the like may be applied to the cooling roller 230. Further, it is preferable that the cooling roller 230 be drivenly rotated by the movement of the sheet 122. Since the cooling roller 230 comes into contact with the sheet 122, cooling efficiency is improved as compared to a non-contact type cooling method.

Further, in this embodiment, the sheet 122 has been cooled during being conveyed by the conveying belt 196. However, the invention is not limited thereto. The sheet 122 may be cooled before being stacked on the discharge tray 192 after the fixing of an image. For example, fans may be provided at the upper portion of a side wall of the discharge tray 192, and air may be blown against the sheet 122 in the lateral direction so as to cool the sheet 122 while the sheet 122 is discharged from the upper side to the discharge tray 192 which is provided on the lower side.

<Others>

The embodiment of the invention has been described above. However, the invention is not limited to the embodiment at all and it goes without saying that the invention may have various modifications without departing from the scope of the invention.

For example, an inkjet image forming apparatus using water-based ink where water is used as a solvent has been described in the embodiment. However, the liquid to be ejected is not limited to ink for the recording of images and the printing of characters, and various kinds of liquid may be applied as the liquid to be ejected as long as using dispersion media or a solvent permeating into a recording medium.

What is claimed is:

1. An image forming apparatus comprising:

a liquid droplet ejection device that ejects liquid droplets onto a recording medium;

a fixing device that fixes the ejected liquid droplets to the recording medium by heating;

a discharge unit on which the recording medium is sequentially discharged and stacked; and a cooling device that cools the recording medium before the recording medium is stacked on the discharge unit after the recording medium is heated by the fixing device; wherein the cooling device includes a cooler, which lowers a temperature around the recording medium.

2. The image forming apparatus of claim 1, wherein the cooling device includes a fan that blows air to the recording medium.

3. The image forming apparatus of claim 2, wherein the fan blows the air toward an upstream side in a conveying direction of the recording medium.

4. The image forming apparatus of claim 2, wherein an air blowing direction of the fan is substantially opposite to a conveying direction of the recording medium.

5. The image forming apparatus of claim 2, wherein the fan is disposed at a position against which cool air blown out from a blow-out portion of the cooler is blown.

6. The image forming apparatus of claim 1, wherein the cooler is disposed above the recording medium which is conveyed in the cooling device.

7. An image forming apparatus comprising:

a liquid droplet ejection device that ejects liquid droplets onto a recording medium;

a fixing device that fixes the ejected liquid droplets to the recording medium by heating;

a discharge unit on which the recording medium is sequentially discharged and stacked; and a cooling device that cools the recording medium before the recording medium is stacked on the discharge unit after the recording medium is heated by the fixing device;

wherein the cooling device is a cooling roller that is rotated while contacting the recording medium.

8. An image forming method comprising:

ejecting liquid droplets onto a recording medium;

fixing the ejected liquid droplets to the recording medium by heating;

cooling the recording medium that has been heated by the fixing; and discharging the recording medium that has been cooled by the cooling, and stacking the recording medium on a discharge unit; wherein the recording medium is cooled by a cooling device including a cooler, which lowers a temperature around the recording medium.

* * * * *